US005172294A

United States Patent [19]

Ineichen et al.

[11] Patent Number: 5,172,294

[45] Date of Patent: Dec. 15, 1992

[54] PROTECTION SWITCH

[75] Inventors: Kurt Ineichen, Emmenbrücke; Josef Flory, Reussbühl, both of Switzerland

[73] Assignee: Weber Protection AG, Emmembrucke, Switzerland

[21] Appl. No.: 839,187

[22] Filed: Feb. 21, 1992

[30] Foreign Application Priority Data

Feb. 22, 1991 [CH] Switzerland ..... 542/91

[51] Int. Cl.[5] ..... H01H 73/00

[52] U.S. Cl. ..... 361/115; 361/93; 335/20

[58] Field of Search ..... 361/88, 91, 49, 115, 361/93; 335/20, 6

[56] References Cited

U.S. PATENT DOCUMENTS

| | | | |
|---|---|---|---|
| 4,206,430 | 6/1980 | Busch et al. | 335/20 |
| 4,635,013 | 1/1987 | Lemarquand | 335/20 |
| 4,768,007 | 8/1988 | Mertz et al. | 361/115 |
| 5,079,529 | 1/1992 | Ohishi et al. | 335/20 |

*Primary Examiner*—Todd E. DeBoer

*Attorney, Agent, or Firm*—Tarolli, Sundheim & Covell

[57] ABSTRACT

A protection switch with sudden switching on and off, a trip-free release and forced opening is described. A manually movable actuator (10) forms with a U-clip (50) a toggle lever. One leg (51) of the U-clip (50) forming the toggle joint axis is displaceably guided in the actuator (10) in a link (15) with a variable spacing from its rotation axis (11) and against the action of a spring (14) supported on the actuator (10). The other leg (52) of the U-clip (50) is guided in a fixed link (25) and in a ratchet lever (40). The ratchet lever (40) serves to transfer movement to a contact arrangement (21, 22) and cooperates with the release ratchet (60) of an overcurrent and/or undervoltage monitoring device. The fixed link (25) controls the engaging movement of the ratchet lever (40). In an intermediate position of the ratchet lever, it has a detent (26), which only releases said other leg (52) of the U-clip (50) following the further movement of the actuator (10) over and beyond the dead center position of the toggle lever (10, 50) and the tensioning of the spring (14) for sudden contact closure. The construction requires a minimum of parts, particularly if the spring (14) is directly shaped onto the actuator.

11 Claims, 3 Drawing Sheets

PROTECTION SWITCH

TECHNICAL FIELD

The invention relates to a protection switch, particularly an appliance protection switch, with a unipolar or multipolar contact agreement, with a rotatably mounted actuator manually movable between an engaging and a disengaging position, with a further toggle lever leg forming a toggle lever with the actuator as the first toggle lever leg, as well as with a two-armed ratchet lever for motion transmission between the actuator and the contact arrangement, the ratchet lever cooperating by means of a contact arm with the contact arrangement and by means of a release arm with the release ratchet of an overcurrent and/or undervoltage monitoring device and is pivotably supported therebetween at the end of the further toggle lever leg, the first toggle lever leg formed by the actuator being shortenable against the action of a spring with respect to its length determined by the distance between the toggle lever joint axis and the rotation axis of the actuator, in that the toggle lever joint axis on the further toggle lever leg is fixed and is displaceably guided against the action of a spring in a first link extending in the actuator with a variable distance from said rotation axis, said end of the further toggle lever leg carrying an axle journal, which is guided in a fixed, further link controlling the engaging movement of the ratchet lever, in an intermediate position of the ratchet lever a catching of the axle journal takes place in the further link during the engaging movement at least until the dead centre position of the toggle lever is reached and in which a spring is provided, which is tensioned during the engaging movement when the axle journal is caught and which brings about a sudden contact closure on releasing the catching action and accompanied by an at least partial detensioning.

Apart from manual engagement and disengagement, protection switches must fulfil in a very reliable manner a number of different functions. In the case of overcurrent and/or undervoltage in the circuit of the appliance to be protected, which is established by corresponding monitoring devices, they must automatically trip, i.e. interrupt the circuit. Automatic contact opening must still be ensured if the actuator is blocked in the engaging position (so-called trip-free release). It must also be possible to separate the contacts by action on the actuator, even if they are welded or fused together or in some other way stick to one another (so-called forced opening). In order to ensure a long life, reliable operation and the maintaining of the once set release values after a large number of switching operations, when designing the switch it must be ensured that there is minimum wear, particularly a minimum contact burning. Thus, the additional requirement is set on the switching and release mechanism, that both opening and closing of the contact takes place suddenly and is not influenceable by the manual movement of the actuator ("engaging-/disengaging jump"). The protection switch must take up the minimum of space and must be manufacturable inexpensively in large numbers.

PRIOR ART

A switch with the aforementioned constructional features is known from FR-A1-2 628 261. The known switch is constructed with numerous parts, which make manufacture and in particular assembly more expensive.

In particular, it has a large number of springs. Both toggle lever legs are length-variable. The locking of the axle journal in the fixed link takes place by means of a further link in a part movable with respect to the first link and provided for this purpose.

DE-A-28 09 754 discloses an appliance protection switch, which also has some of the aforementioned constructional features, but in which when operating by hand a "creeping" opening and closing of the contacts is possible. The sudden opening can only reliably take place when the ratchet lever is automatically released or tripped by the monitoring device.

EP-A1-0 205 361 describes a sudden switching on in the case of a miniature switch, in which between a toggle lever and the actuator there is a spring-loaded intermediate member, the spring being tensioned during switching on in order to bring about said sudden switching on. An axle journal at the "free" end of a toggle lever leg constructed as a U-clip is guided in a link, which is provided with a detent for the axle journal in an intermediate position. Both the toggle lever legs have a constant length. The release of the catching of the axle journal in the link takes place forcibly by the displacement of the link and is cut into a movable part specifically provided for this purpose.

DE-Ul-87 01 048.8 discloses a latch for a circuit breaker with only a pseudo-fast switching on, which is brought about by guiding the toggle lever joint axis in a fixed link provided with a beval and passing on a circular ring around the rotation axis of the actuator. In the case of the known construction disadvantageous transverse forces occur on the moving parts.

DESCRIPTION OF THE INVENTION

The object of the invention is to provide a protection switch, which fulfils the requirements indicated hereinbefore, but which requires fewer parts. According to the invention this is achieved in that the further toggle lever leg is constant with respect to its length determined by the distance between the toggle lever joint axis and the axle journal, that for actuating the toggle lever joint axis and for bringing about the sudden contact closure there is only a single spring supported on the actuator and that the axle journal is held in the further link during the engaging movement merely by engaging on a detent constructed in the link and from which it automatically slides after overcoming the dead centre position of the toggle lever.

The invention is described in greater detail hereinafter relative to a non-limitative embodiment and in conjunction with the attached drawings.

SHORT DESCRIPTION OF THE DRAWINGS

WAYS OF CARRYING OUT THE INVENTION

Figure 1:
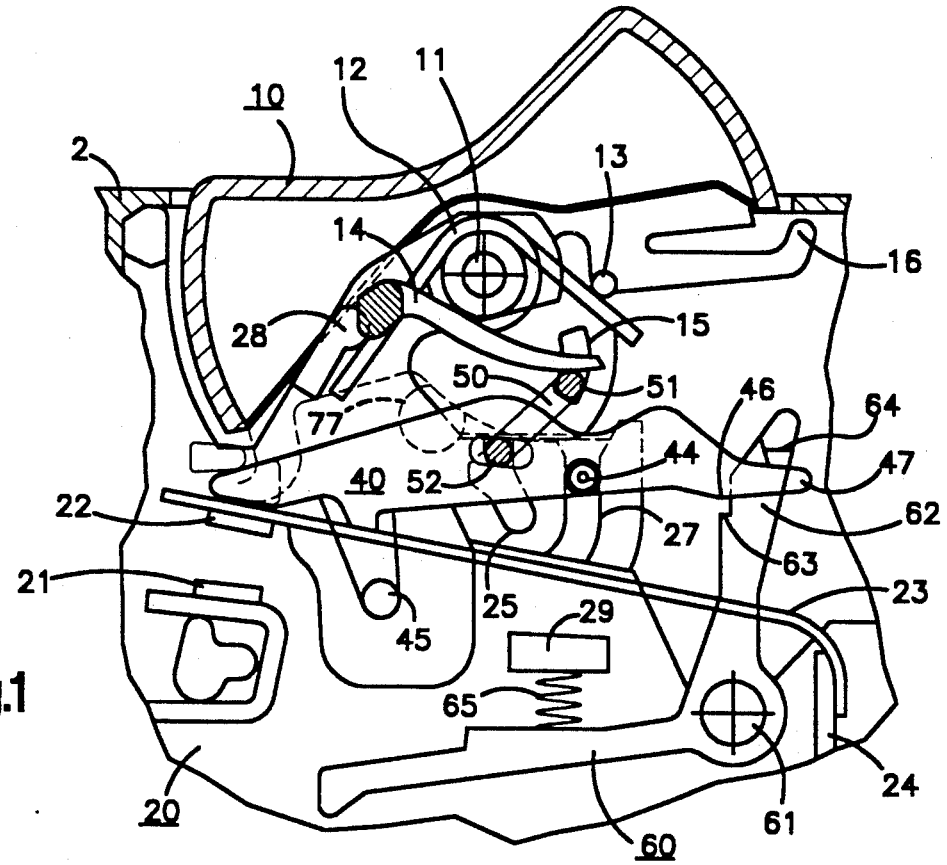
FIG. 1 is a diagrammatic partial representation of an inventive appliance protection switch in the off position.
Figure 2:
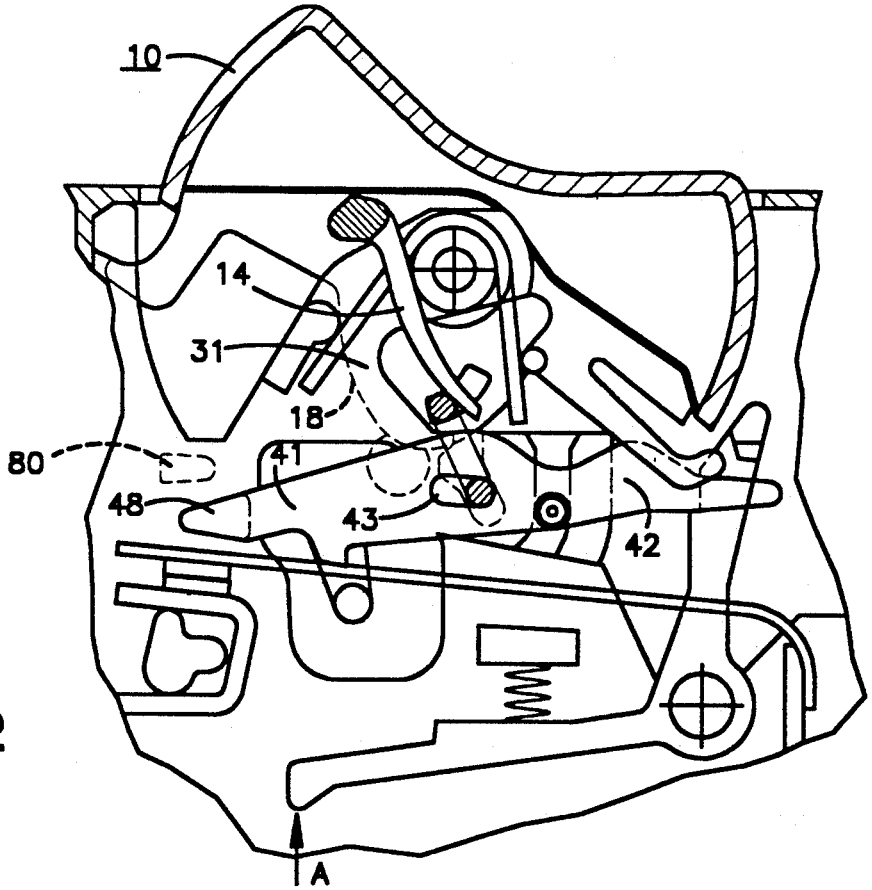
FIG. 2 is the corresponding representation of the switch in the on position.

The appliance protection switch according to FIGS. 1 and 2 is constructed as follows. On a fixed carrier 20 located in a switch casing 2 (both shown in broken away form) is fitted the contact arrangement, which comprises the fixed contact 21 and the movable opposite contact 22, the latter being located at the free end of a contact spring 23, which is fixed to the connection 24. Preferably it is a two-pole switch, a similar contact arrangement being installed on the back of the support 20 (shown in FIGS. 1 and 2). The subsequently described actuating and release mechanism is then associated jointly with the two contact arrangements. The actuator for the manual switch operation is a rocker 10. The latter is pivotably mounted by means of a spindle 11 on an arm 31 (FIG. 2) of the support 20 and can therefore be pivoted either into the disengaged or off position according to FIG. 1 or the engaged or on position according to FIG. 2. In per se known manner the rocker 10 can be constructed in two parts with an inner rocker carrier and an outer, replaceable "cap". A rocker spring 22 wound around the rocker spindle 11 is supported with one end on a rocker cam 13 and with the other end on a cam 28 of the support and is tensioned in the on position on pivoting the rocker.

The rocker 10 forms, as a first toggle lever leg, with a further toggle lever leg 50 described in greater detail hereinafter, a toggle lever, whose joint axis is designated 51. On the "free" end 52 of the toggle lever leg 50 is supported a two-armed ratchet lever 40, which is used for movement transmission between the actuator 10 and the contact arrangement.

One arm 41 of the ratchet lever 40, referred to as the contact arm here, cooperates with the contact arrangement or with the contact spring 23. The other arm 42, known here as the release arm, cooperates with the release ratchet 62 of a not shown monitoring device. In per se known manner the release ratchet 62 can be located on one arm of a release lever 60 in the form of an angle lever. The latter is mounted by means of a spindle 61 on the support 20 and is normally held in the represented position by a compression spring 65, which is supported between a fixed cam 29 and the other release lever arm. The not shown monitoring device acts in the direction of the arrow A (FIG. 2) on the release lever 60, in order to pivot it clockwise counter to the tension of the spring 65. It can be a thermal or magnetic overcurrent release and/or an undervoltage or operating current relay, or a mechanical safety release. A ratchet edge 46 of the ratchet lever 40 is supported with the switch on on the ratchet face 63 of the release ratchet 62 (FIG. 2). If in the described manner the release lever 60 is pivoted, then the ratchet edge 46 slides from the face 63, so that the protection switch is tripped.

Figure 3:
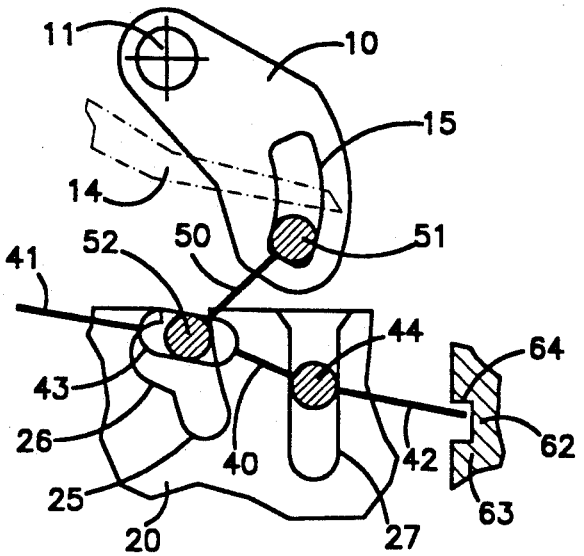
FIGS. 3 to 6 show in highly diagrammatic form a switching on operation in four successive movement phases.
Figure 4:
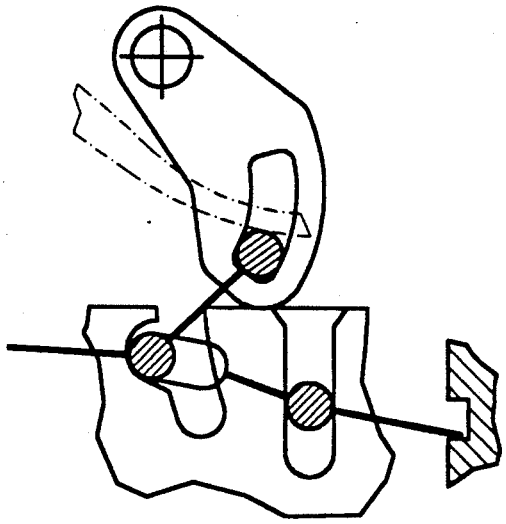

A description will now be given of the special construction of the switching mechanism, which ensures a sudden contact closure on switching on, which cannot be influenced by the manual movement of the actuator 10 ("switch on jump"). FIGS. 3 to 6 illustrate the movement sequence. FIG. 3 corresponds to the off position according to FIG. 1, FIG. 4 shows the situation after a first partial movement, FIG. 5 after further movement just prior to the jump and FIG. 6 corresponds to the on position according to FIG. 2.

The joint spindle 51 of the toggle lever 10, 50 is displaceable along a link 15 in the actuator 10. The link 15 in the actuator 10 extends with a variable spacing from its rotation axis 11. Through the displacement of the toggle lever spindle 51 in the link 15 there is a change in the length of the toggle lever leg formed by the actuator 10 and which is determined by the distance between the spindle 51 and the rotation axis 11 of the actuator 10. A displacement of the spindle 51 takes place in opposition to a leaf or elastic spring 14 supported on the actuator 10 and engaging with a certain pretension on the toggle lever spindle 51.

The toggle lever leg 50 is constructed as a U-shaped clip, which on the one hand forms the toggle lever joint spindle 51 and on the other an axle journal 52 parallel thereto and which represents the end of the leg 50, i.e. the two parallel legs of the U-clip form the two spindles 51 and 52. The ratchet lever 40 is pivotably supported on the axle journal 52 in an elongated hole 43, which extends roughly in the longitudinal direction of the ratchet lever and in which the journal 52 can slide during switch actuation. In addition, the axle journal 52, which represents the end of the toggle lever leg 50, is guided along a fixed link 25. The latter is provided on the support 20 and controls the engaging movement of the ratchet lever 40 in the following way. If the actuator 10 is pivoted clockwise starting from the disengaged position (FIGS. 1 and 3), the toggle lever 10, 50 is "stretched". In a first movement phase the ratchet lever 40 is pressed downwards from the leg 50 and its contact arm 41 guides the movable contact 22 up to a short distance from the fixed contact 21 and the ratchet edge 46 on the release arm 42 engages on the ratchet face 63 of the release ratchet 62 (FIG. 4). During this first phase the leg and 52 in the elongated hole 43 is moved forwards and passes into an indentation 26 in the link 25. In this intermediate position of the ratchet lever 40, the said indentation 26 forms a detent for the end 52. On further pivoting the actuator the end 52 initially remains "trapped" in the detent 26 and the position of the ratchet lever 40 is unchanged. However, there is a displacement of the joint spindle 51 upwards along the link 15 and on the one hand the toggle lever leg formed by the actuator 10 is shortened and on the other the spring 14 is tensioned. This situation can be gathered from FIG. 5, in which the toggle lever 10, 50 is shown roughly in its dead centre position or shortly prior to reaching the latter. The shortening of the toggle lever leg formed by the actuator 10 is necessary to allow the further movement of the actuator 10 following the catching of the end 52 on the detent 26 and the toggle lever can be moved beyond its dead centre position.

Figure 5:
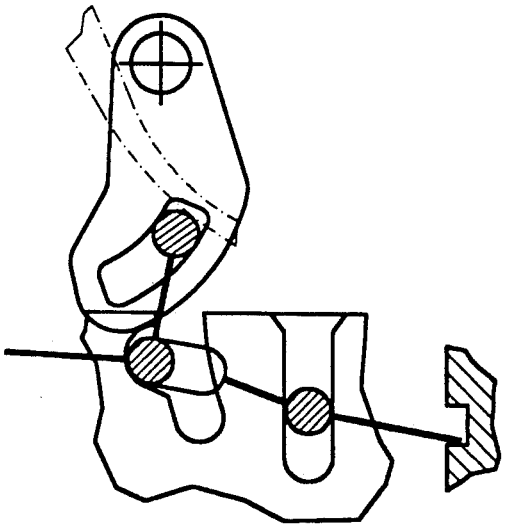
Figure 6:
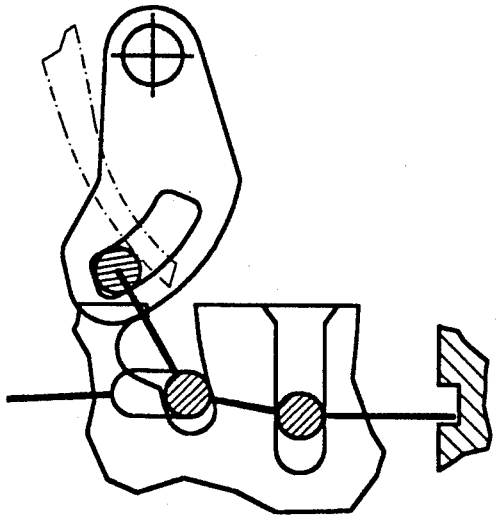

During the aforementioned movement sequence the toggle lever leg 50 changes its direction relative to the link 25 (compare FIGS. 4 and 5). Thus, during the further movement of the actuator in the position according to FIG. 5 or shortly thereafter, i.e. after passing through the dead centre position, it necessarily arises that the end 52 is disengaged from the detent 25, i.e. the detent frees the toggle lever leg 50 and the ratchet lever 40. Under the action of the tensioned spring 14 the toggle lever leg 50 springs downwards along the fixed link 25 and the link 15 and the end 52 carries with it the ratchet lever 40 for sudden contact closure. The ratchet lever 40 is pivoted about its ratchet edge 46 resting on the ratchet face 63 by a relatively small angle. As a result of the aforementioned, introductory approximation of the contacts only a short contact path has to be suddenly covered up to contact closure, which significantly contributes to the avoidance of undesired contact chattering. FIGS. 2 and 6 show the suddenly occurring end position (on/engaging position).

It is particularly important that the aforementioned sudden movement sequence from the position of FIG. 5 to that of FIG. 6 is not influenced by the actuator 10, i.e. a "creeping" contact closure is not possible. However, it is advantageous to notice the tensioning of the spring 14 and then its sudden resistance reduction on the actuator.

The engaging position is maintained in that the toggle lever 10, 50 has in this position passed beyond its dead centre and that the ratchet lever 40 is under the action of the contact spring 23, which is slightly bent for producing the contact pressure.

As the switch often remains for a long time in the on position, it is advantageous if the "elastic spring" 14 is subject to minimum loading in the on position, or at least said loading does not significantly exceed that in the off position, because otherwise it could deteriorate over a period of time. As can be gathered from FIG. 6, the guide 15 (link) for the joint spindle 51 is directed substantially at right angles to the direction of the leg 50 in the on position or at least at an angle such that the force component of the force exerted by the leg 50 is much less in the longitudinal direction of the guide than at right angles thereto. Thus, as desired, in the on position the elastic spring 14 is only subject to a limited permament loading. This arrangement is possible because the link 15 is provided in the actuator 10 and moves therewith.

As the spring 14 is not significantly loaded in either the engaged or disengaged position, it is possible to make it from plastic. This also makes it possible to shape it directly onto the actuator 10 and to produce the latter and the spring 14 as e.g. a single one-piece plastic injection moulding. It is also advantageous from the assembly standpoint that this economizes one part, i.e. the spring, so that the latch of the appliance protection switch according to the invention only comprises three parts, namely the actuator, the U-clip and the ratchet lever. This represents the absolute minimum of parts with which the aforementioned multiple requirements such as sudden switching on and off, trip-free and forced release can be brought about.

The following is also necessary with respect to the movement sequence on switching on. Apart from the link 25 with the detent 26, the support 20 has a further link or guide 27, in which slidingly engages a pin 44 of the ratchet lever 40. Thus, the latter is guided against shifting in its longitudinal direction with respect to the fixed link 25. Otherwise such longitudinal displacements could occur due to the sliding movements of the end 52 in the elongated hole 43 (cf. FIGS. 3 to 6) and then influence the bearing position of the ratchet edge 46 on the ratchet face 63, so that there would be a change to the set release values for the protection switch.

In the engaged state (FIG. 2), the rocker spring 12 is tensioned and acts counterclockwise on the rocker 10. However, it is unable to overcome the locking of the toggle lever 10, 50 for as long as the ratchet lever 40 is locked in the represented position on the release ratchet 62 and is loaded by the tension of the contact spring 23. However, as soon as a monitoring device brings about the pivoting of the release lever 60 by an adequate amount (arrow A in FIG. 2), the ratchet edge 46 slides off the ratchet face 63, so that the aforementioned locking of the toggle lever suddenly stops. The spring 12 pivots the actuator 10 back into the disengaged position and the ratchet lever contact arm 41, so that it is pivoted upwards by the contact spring 23 and the contacts suddenly open.

The sudden opening of the contacts also occurs if during the automatic release the actuator should become locked in the engaged position (trip-free release). Although the toggle lever 10, 50 remains in the position according to FIG. 2, the ratchet lever is pivoted round the end 52 of the leg 50.

Figure 7:
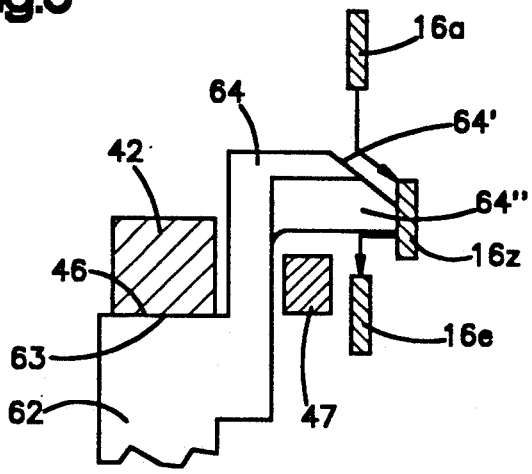
FIG. 7 is a basic representation of the parts in the vicinity of the release ratchet (considered in the longitudinal direction of the ratchet lever to the release ratchet) for illustrating the switching off or disengaging process.

The sudden opening of the contacts is also ensured in the case of disengagement by manual actuation of the rocker 10, namely due to the appropriate action on the release lever 60 or the release ratchet 62 by the actuator 10, as will be explained hereinafter relative to FIGS. 1 and 2 in conjunction with FIG. 7. On the actuator 10 is provided a disconnection member 16 in the form of an arm 16, which projects radially with respect to the axis 11 and on the upper end of the release ratchet 62 is shaped a lateral cam 64, which is located in the pivoting range of the free end of the arm 16. The cam 64 has a first inclined plane 64' and a second inclined plane 64'' (FIG. 7). During the engaging movement of the actuator 10, starting from the inoperative position **16*a* (FIG. 7), the arm 16 is resiliently deflected along the inclined plane 64' into an intermediate position 16z, then jumps back into the position 16*a*, so that in the on position (FIG. 2), it is located below the cam 64 alongside the release ratchet. During manual disengagement the arm 16 is pivoted with the actuator, so that it slides upwards on the inclined plane 64'' and thereby clockwise deflects the release ratchet 62. Thus, the switch is forcibly suddenly tripped in the same way, as described hereinafter in conjunction with the automatic release. It must be borne in mind that even in the case of a slow disengaging movement and a corresponding "creeping" deflection of the release ratchet 62, there is no corresponding decrease in the contact pressure and in fact it initially increases somewhat, because simultaneously the toggle lever 10, 50 is completely extended from the slightly bent in on position according to FIG. 2** until the dead centre is overcome.

The following comments are made in connection with the engaging movement. The geometrical arrangement is preferably chosen in such a way that during the movement portion, in which the arm 16 slides downwards over the inclined plane 64' and is resiliently deflected by the cam 64, the downward movement is directed substantially radially to the pivot axis of the release lever 60. This ensures that the release ratchet on engagement by the arm 16 does not undergo a pivoting movement, which could impair the release precision (the ratchet edge 46 already being located on the ratchet face 63 when the arm 16 is resiliently deflected).

The cam 64 at the end of the release ratchet 62 also engages over a shoulder 47 on the ratchet lever, which extends beyond the ratchet edge 46. This limits the path by which the ratchet arm 42 can rise. On the contact arm 41 of the ratchet lever is shaped a cam 45, which engages under the contact spring 23. This construction ensures that the contacts can be separated both after automatic release and during manual disengagement by action on the actuator 10 (forced opening), if they should stick to one another and the tension of the tensioned contact spring 23 is not sufficient for contact separation purposes.

The present appliance protection switch is also eminently suitable for operating an auxiliary contact unit located outside the switch, as will be subsequently described. Auxiliary contacts are used for indicating or control purposes and must change their switching position simultaneously with the protection switch contacts, independently of whether the protection switch is operated manually or is automatically tripped.

Figure 8:
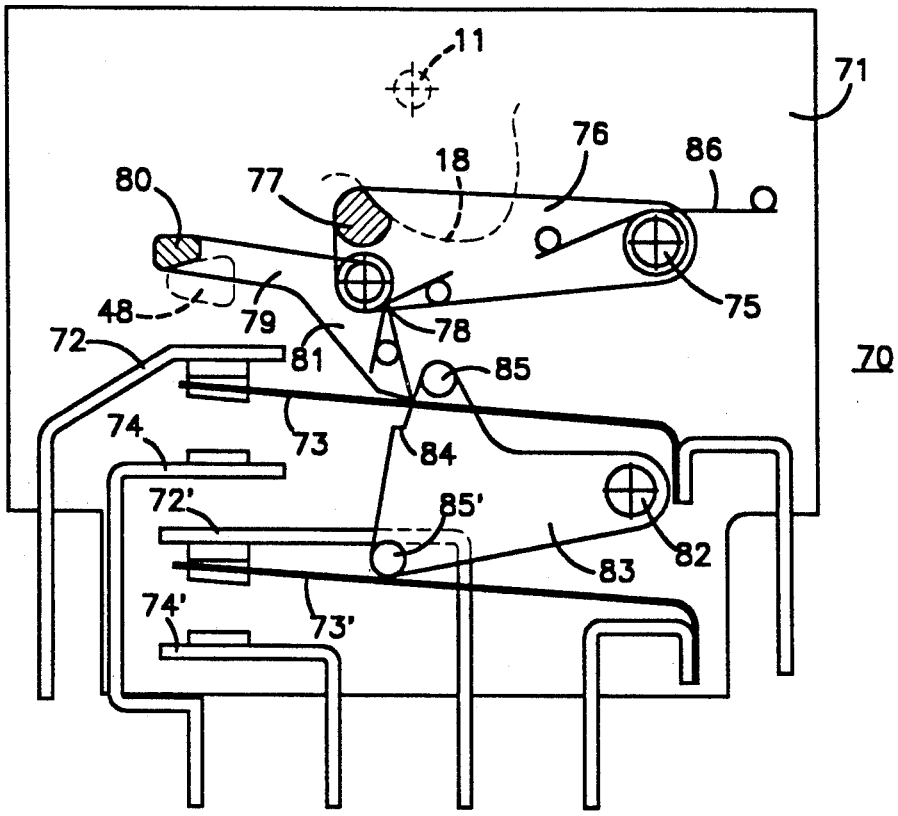
FIG. 8 shows diagrammatically an auxiliary contact unit operated by the switch with the switch disconnected.
Figure 9:
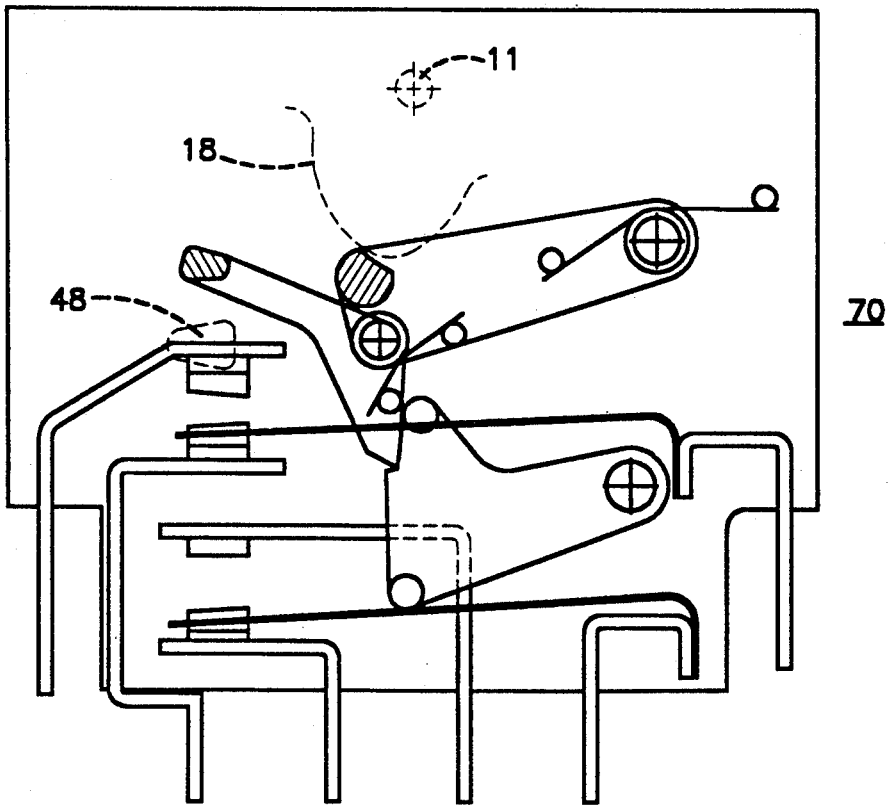
FIG. 9 is the corresponding representation with the switch connected.

FIGS. 8 and 9 diagrammatically show an auxiliary contact unit 70, which is fitted to the protection switch according to FIGS. 1 and 2, preferably laterally outside the switch casing 2. The auxiliary contact unit 70 contains two switching contacts, which are in each case simultaneously operated. A movable contact on the contact springs 73 or 73' cooperates with two fixed contacts 72, 74 or 72', 74'. The switching position according to FIG. 8 corresponds to the off position of the protection switch according to FIG. 1 and the switching position according to FIG. 9 corresponds to its on position according to FIG. 2.

The contact arrangement of the auxiliary contact unit 70 and its actuating mechanism are located on a common support or a base plate 71. The actuating mechanism can, e.g. as shown, have the following construction. A first cover plate 76 and a second cover plate 83 are mounted in pivotable manner on the base plate 71 in each case by means of a journal pin 75 or 82. By means of a pin 78, the first cover plate 76 carries a two-armed ratchet 79, whose ratchet arm 81 cooperates with a shoulder 84 on the second cover plate 83. A first tension spring 86 attempts to pivot the first cover plate 76 upwards. A further tension spring located on the pin 78 determines the pivoting position of the two-armed ratchet 79 with respect to the first cover plate 76. The second cover plate 83 has two cams 85 or 85' for moving along the contact springs 73 or 73'.

For operating the auxiliary contact unit 70 a "rising" cam path 18 with respect to the rocker axis 11 is provided on the protection switch rocker 10. A cam 77 projecting sideways from the first cover plate 76 of the unit 70 projects into the switch casing 2 and is located in the vicinity of the cam path 18 (the position of the rocker axis 11 and the cam path 18 are shown in dot-dash line form in FIGS. 8 and 9, in the same way as the position of the actuating cam 77 in FIGS. 1 and 2). If the protection switch is switched on by pivoting the rocker 10, then the cam path 18 presses the cam 11 downwards and by means of the shoulder 84, the ratchet arm 81 drives the second cover plate 83, which in turn brings the contact springs into the switching position according to FIG. 9. The configuration of the cam path 18 with respect to the movement direction of the cam 77 is chosen in such a way that neither the tension spring 86, nor the contact springs 73 and 73' exert a disturbing torque on the rocker 10 in the on or engaged position. On pivoting back the rocker 10 into the disengaged position, either manually or by automatic switch tripping, the cam 77 follows the cam path 18, so that the auxiliary contact unit again assumes the position according to FIG. 8.

The following measure ensures that also in the case of the trip-free release of the protection switch (i.e. if the rocker 10 in the case of automatic release remains in the engaged position according to FIG. 2) the auxiliary contact unit 70 is automatically unlocked and its contacts pass into the position according to FIG. 8 simultaneously with the opening of the protection switch contacts. A release cam 80 projects from the ratchet 79 and projects laterally into the protection switch casing 2 and is located in the movement area of the contact arm 41 of the ratchet lever 40. Preferably onto the end of the arm 41 is shaped a cam 48 for cooperating with the release cam 80. In the case of normal switching on and off and also normal automatic tripping of the protection switch, a cooperation takes place between the cams 80 and 48. However, with the aforementioned trip-free release the toggle lever with the cam 48 forces the release cam 80 upwards, because the actuating mechanism of the auxiliary contact unit by means of the cam path 18 and the cam 77 initially remains in the position according to FIG. 9. Thus, the two-armed ratchet is pivoted by the cam 48, so that it release the cover plate 83 and the contact springs 73, 73' cam pivot upwards. If, as shown in FIGS. 2 and 9, the release cam 80 is spaced from the cam 48 of the arm 41 in the on position, it is ensured that the sudden opening of the protection switch contacts is not impeded by the release mechanism of the auxiliary contact unit.

The described appliance protection switch according to FIGS. 1 and 2 could fundamentally be constructed with an actuator for a sliding movement or in the form of a pushbutton, in place of with a pivotable rocker 10. The switch is characterized by a long life and operational reliability during all switching and release processes. Compared with the known constructions, where switching on and off does not take place suddenly, no additional parts are required. The switch is particularly suitable for automatic assembly, because the joining together of the parts only takes place in two directions (in the drawing plane of FIGS. 1 and 2 and at right angles thereto). Thus, the switch is eminently suitable for rational manufacture in large numbers.

We claim:

1. Protection switch, with a unipolar or multipolar contact arrangement (21, 22), with a rotatably mounted actuator (10) manually movable between an engaging and a disengaging position, with a further toggle lever leg (50) forming a toggle lever with the actuator as the first toggle lever leg, as well as with a two-armed ratchet lever (4) for motion transmission between the actuator and the contact arrangement, the ratchet lever (40) cooperating by means of a contact arm (41) with the contact arrangement and by means of a release arm (42) with the release ratchet (62) of an overcurrent and/or undervoltage monitoring device and is pivotably supported therebetween at the end (52) of the further toggle lever leg (50), the first toggle lever leg formed by the actuator (10) being shortenable against the action of a spring with respect to its length determined by the distance between the toggle lever joint axis (51) and the rotation axis (11) of the actuator, in that the toggle lever joint axis (51) is fixed on the further toggle lever leg (50) and is displaceably guided against the action of a spring in a first link extending in the actuator (10) with a variable distance from said rotation axis (11), said end (52) of the further toggle lever leg (50) carrying an axle journal (52), which is guided in a fixed, further link (15) controlling the engaging movement of the ratchet lever (40), in an intermediate position of the ratchet lever (40) a catching of the axle journal (52) takes place in the further link (25) during the engaging movement at least until the dead centre position of the toggle lever (10, 50) is reached and in which a spring is provided, which is tensioned during the engaging movement when the axle journal (52) is caught and which brings about a sudden contact closure on releasing the catching action and accompanied by an at least partial detensioning, characterized in that the further toggle lever leg (50) is constant with respect to its length determined by the distance between the toggle lever joint axis (51) and the axle journal (52), that for actuating the toggle lever joint axis (51) and for bringing about the sudden contact closure there is only a single spring (14) supported on the actuator (10) and that the axle journal (52) is caught in the further link (25) during the engaging movement merely by engaging on a detent (26) constructed in the link and from which it automatically slides after overcoming the dead centre position of the toggle lever (10, 50).

2. Protection switch according to claim 1, characterized in that the further toggle lever leg (50), the toggle lever joint spindle (51) and the axle journal (52) are formed by a U-shaped clip.

3. Protection switch according to claim 1 characterized in that the axle journal (52) also engages in an elongated hole (43) in the ratchet lever (40), which extends somewhat in the longitudinal direction thereof.

4. Protection switch according to claim 1 characterized in that the ratchet lever (40) is guided against shifting in its longitudinal direction with respect to the fixed links (25).

5. Protection switch according to claim 1 characterized in that the spring (14) is relieved in the engaged position and is shaped onto the actuator, preferably as a leaf spring.

6. Protection switch according to claim 1 characterized in that in the engaged position of the actuator (10), the first link (15) constructed therein is so directed with respect to the force exerted thereon by a further toggle lever leg (50), that the force component in the longitudinal direction of the link (15) is smaller than the force component at right angles thereto.

7. Protection switch according to claim 1, characterized by a disengaging member (16) connected to the actuator (10) and cooperating with the release ratchet (62) pivotably mounted about the spindle (61) and which with the engaging movement of the actuator (10) passes into a position engaging over the release ratchet (62) and during the disengaging movement pivots the release ratchet (62) into a release position freeing the ratchet lever (40).

8. Protection switch according to claim 7, characterized in that the movement of the disengaging member (60) with respect to the release ratchet (62) is directed substantially radially to the pivot pin (61) of the release ratchet, so that the latter is not subject to any moment in the release direction on engaging.

9. Protection switch according to claim 1, characterized in that on the release ratchet (62) is provided a cam (64), which engages over the arm (42) of the ratchet lever (40) on the side opposite to the ratchet face (63) of the release lever (62), in order to ensure a forced opening of the contacts (21, 22) by means of the ratchet lever (40).

10. Protection switch according to claim 1, characterized in that its actuator (10) has a cam path (18) for operating an auxiliary contact unit (70) located outside the protection switch and an actuating cam (77) belonging to the actuating mechanism (76, 79, 83) of the auxiliary contact unit (70) projects into the protection switch in the movement range of said cam path (18).

11. Protection switch according to claim 10, characterized in that in the movement range of the contact arm (41) of the ratchet lever (40) is provided a release cam (80) belonging to the actuating mechanism of the auxiliary contact unit (70) and which in the engaged position is spaced from said contact arm (41).

* * * * *